US008702279B2

(12) United States Patent
Oki

(10) Patent No.: US 8,702,279 B2
(45) Date of Patent: Apr. 22, 2014

(54) LIGHTING APPARATUS

(75) Inventor: Isamu Oki, Tainan (TW)

(73) Assignee: Yadent Co., Ltd., Taipei (TW)

( * ) Notice: Subject to any disclaimer, the term of this patent is extended or adjusted under 35 U.S.C. 154(b) by 197 days.

(21) Appl. No.: 13/433,472

(22) Filed: Mar. 29, 2012

(65) Prior Publication Data

US 2012/0250325 A1 Oct. 4, 2012

(30) Foreign Application Priority Data

Apr. 1, 2011 (TW) ..... 100111585 A
Mar. 9, 2012 (TW) ..... 101108087 A

(51) Int. Cl.
*F21V 29/00* (2006.01)

(52) U.S. Cl.
USPC ..... 362/294; 313/46; 362/218; 362/249.02; 362/249.14; 362/373

(58) Field of Classification Search
USPC ..... 313/46; 362/218, 246, 249.01, 249.02, 362/249.14, 294, 373
See application file for complete search history.

(56) References Cited

U.S. PATENT DOCUMENTS 6,634,770 B2 * 10/2003 Cao ..... 362/294
7,771,088 B2 * 8/2010 Chen ..... 362/294
8,436,517 B2 * 5/2013 Oki ..... 313/46

* cited by examiner

*Primary Examiner* — Stephen F Husar
(74) *Attorney, Agent, or Firm* — Stroock & Stroock & Lavan LLP

(57) ABSTRACT

A lighting apparatus includes: a bulb; a heat sink unit disposed in an inner space of the bulb, and including an end wall portion and a sleeve portion; a light-emitting unit disposed on the heat sink unit and including a first circuit board disposed on the end wall portion, a second circuit board disposed around the sleeve portion, and a plurality of light-emitting elements; a heat insulating unit disposed at at least one of a position between the end wall portion and the first circuit board, and a position between the sleeve portion and the second circuit board; an annular seat coupled to the bulb; and an electrical connector coupled to the annular seat.

15 Claims, 7 Drawing Sheets

LIGHTING APPARATUS

CROSS-REFERENCE TO RELATED APPLICATION

This application claims priority of Taiwanese application No. 100111585, filed on Apr. 1, 2011, and Taiwanese application No. 101108087, filed on Mar. 9, 2012.

BACKGROUND OF THE INVENTION

1. Field of the Invention

The invention relates to a lighting apparatus, more particularly to a lighting apparatus with enhanced heat dissipation ability.

2. Description of the Related Art

Light-emitting diodes (LEDs) have advantages of high luminance, energy-saving, etc., and belong to solid-state illuminations. Thus, there is a growing trend for the LEDs to serve as lighting apparatuses. In the case of replacing a conventional lamp (such as a tungsten bulb) using a LED lighting apparatus, a sufficient number of the LEDs should be provided in the LED lighting apparatus to have luminance comparable to the conventional lamp. However, if the heat generated by the LEDs in the LED lighting apparatus is not dissipated efficiently, light degradation may occur due to overheating of the LEDs. As such, the LED lighting apparatus may have a shorter service life.

Accordingly, in order to provide a LED lighting apparatus with improved heat dissipation, the applicant of this invention proposed a LED bulb, as disclosed in U.S. Patent Application Publication No. 20110273072, in which a plurality of LEDs are mounted to a circuit board, and a heat sink is in close contact with the circuit board opposite to the LEDs. With the heat sink, the heat generated by the LEDs can be transferred outwardly through a screw base of the LED bulb.

However, the applicant of this invention found that the heat dissipation problem is likely to occur in a small volume LED bulb (such as one having an E17-type screw base), even if the small volume LED bulb is provided with the aforesaid heat sink. This is because in order to have sufficient luminance, the LEDs in the small volume bulb are arranged in a relatively high density. In addition, since the volume of space inside the LED bulb is relatively small, the heat-exchanging area for the heat sink may be insufficient so that the heat energy generated by the LEDs may not be efficiently transferred to the screw base of the LED bulb through the heat sink, thereby resulting in an increase in the temperature of the LEDs that may shorten the service life of the LED bulb.

SUMMARY OF THE INVENTION

Therefore, the object of the present invention is to provide a lighting apparatus that can overcome at least one of the aforesaid drawbacks associated with the prior art.

According to the present invention, a lighting apparatus comprises:

a bulb having an open end and a closed end opposite to the open end;

a heat sink unit disposed in an inner space of the bulb, and including an end wall portion and a sleeve portion, the end wall portion having two opposite first and second surfaces, and being disposed in proximity to the closed end, such that the first surface faces toward the closed end of the bulb and such that the second surface faces toward the open end of the bulb, the sleeve portion having opposite first and second ends, the first end of the sleeve portion being disposed adjacent to the end wall portion, the second end of the sleeve portion being disposed adjacent to the open end of the bulb;

a light-emitting unit disposed on the heat sink unit and including: a first circuit board disposed on the first surface of the end wall portion, a second circuit board disposed around the sleeve portion, and a plurality of light-emitting elements respectively mounted on the first and second circuit boards;

a heat insulating unit disposed at at least one of a position between the first surface of the end wall portion and the first circuit board, and a position between the sleeve portion and the second circuit board;

an annular seat coupled to the bulb in proximity to the open end; and an electrical connector coupled to the annular seat and adapted for connection to an external power source.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
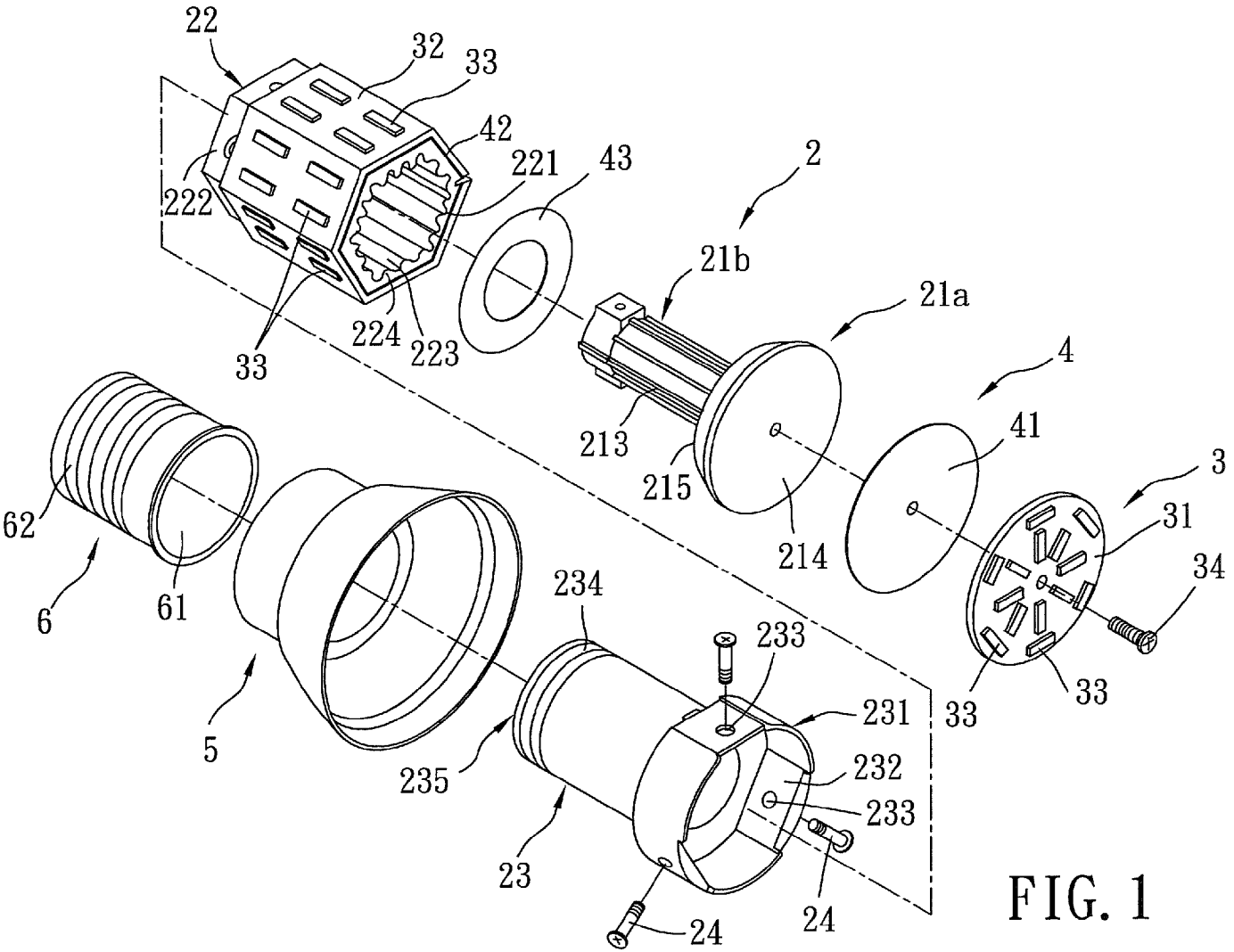
FIG. 1 is an exploded perspective view of the first preferred embodiment of a lighting apparatus according to the present invention.
Figure 2:
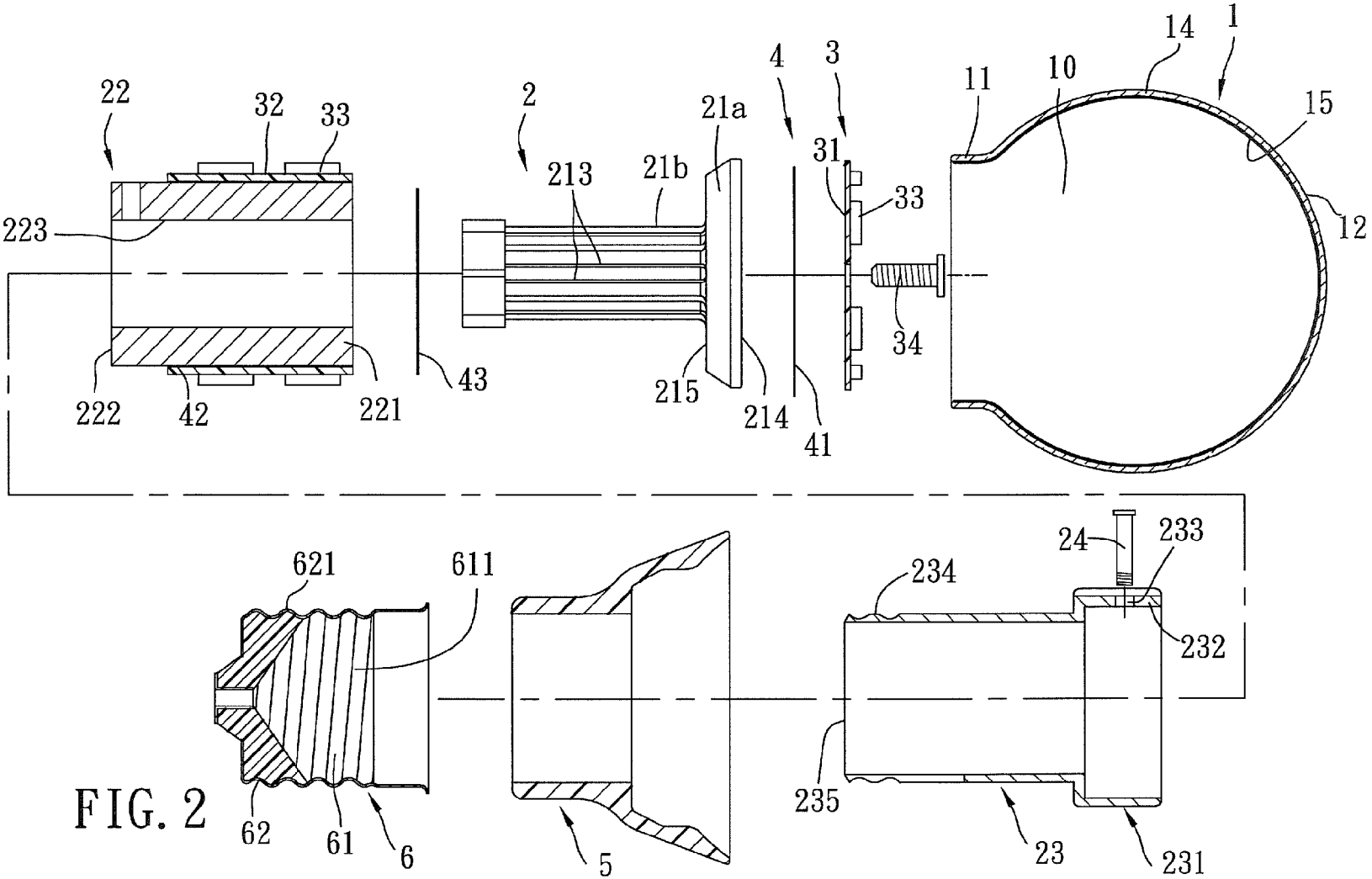
FIG. 2 is an exploded sectional view of the first preferred embodiment of the lighting apparatus according to the present invention.
Figure 3:
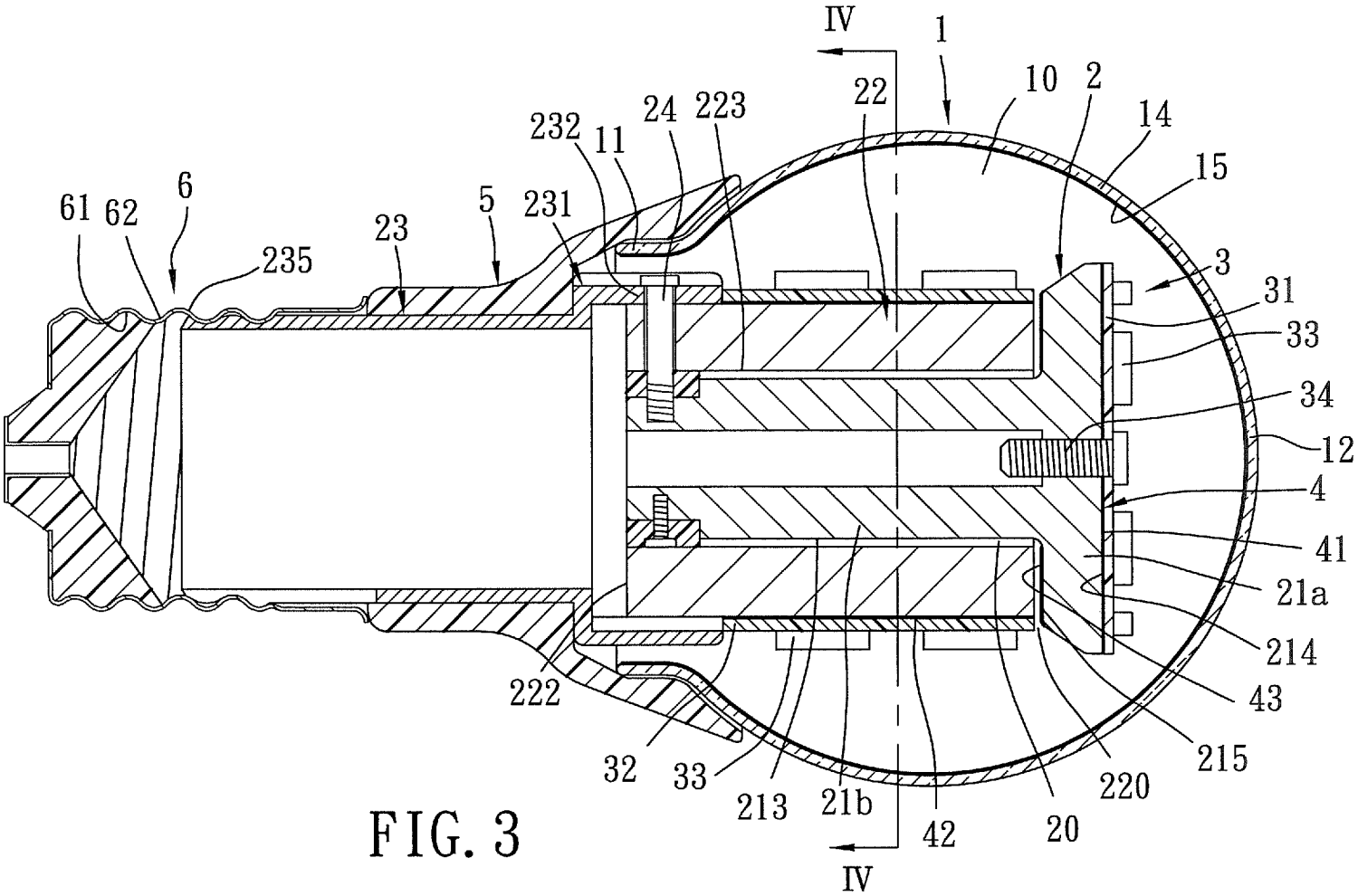
FIG. 3 is a sectional view of the first preferred embodiment of the lighting apparatus according to the present invention.
Figure 4:
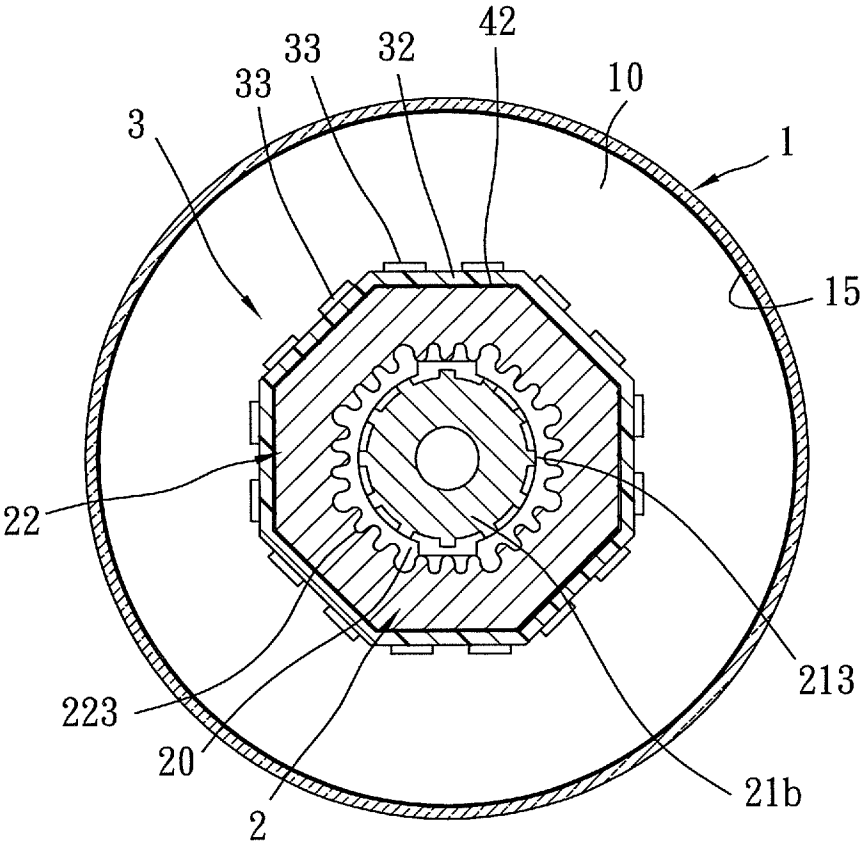
FIG. 4 is a cross-sectional view taken along a line IV-IV in FIG. 3.

Before the present invention is described in greater detail with reference to the accompanying embodiments, it should be noted herein that like elements are denoted by the same reference numerals throughout the disclosure.

Referring to FIGS. 1-4, the first preferred embodiment of a lighting apparatus according to the present invention comprises a bulb 1, a heat sink unit 2, a light-emitting unit 3, a heat insulating unit 4, an annular seat 5, and an electrical connector 6.

The bulb 1 has an open end 11 and a closed end 12 opposite to the open end 11. The bulb 1 can be made of glass, and has a shape similar to that of a conventional tungsten bulb.

The heat sink unit 2 is disposed in an inner space 10 of the bulb 1, and includes an end wall portion 21*a*, a tubular portion 21*b*, and first and second sleeve portions 22, 23.

The end wall portion 21*a* has two opposite first and second surfaces 214, 215, and is disposed in proximity to the closed end 12 of the bulb 1, such that the first surface 214 faces toward the closed end 12 of the bulb 1 and such that the second surface 215 faces toward the open end 11 of the bulb 1.

The tubular portion 21*b* is connected to and extends from the second surface 215 of the end wall portion 21*a*, and is surrounded by the first sleeve portion 22. In this embodiment, the tubular portion 21*b* and the end wall portion 21*a* are formed in one piece, and the tubular portion 21*b* has an outer surface formed with a plurality of protrusions 213 that are spaced apart from each other.

The first sleeve portion 22 is formed into a shape of a hexagonal cylinder in this embodiment. Alternatively, the first sleeve portion 22 may have a shape of other polygonal shapes or that of a circular cylinder. The first sleeve portion 22 has opposite first and second ends 221, 222, and surrounds the tubular portion 21*b*, such that the first end 221 of the first sleeve portion 22 is disposed adjacent to the end wall portion 21*a* and the second end 222 of the first sleeve portion 22 is disposed adjacent to the open end 11 of the bulb 1. The first sleeve portion 22 and the tubular portion 21*b* define a heat-dissipating space 20 therebetween.

The first sleeve portion 22 has an inner surface that is formed with a plurality of troughs 223 and ridges 224, and that faces the outer surface of the tubular portion 21*b*. By virtue of the protrusions 213 of the tubular portion 21*b*, and the troughs 223 and the ridges 224 of the first sleeve portion 22, a heat dissipation area of the heat sink unit 2 is increased, thereby enhancing heat dissipation efficiency of the heat sink unit 2.

The second sleeve portion 23 is formed in a hollow tubular shape, and has two opposite first and second open ends 231, 235. The first open end 231 surrounds the second end 222 of the first sleeve portion 22. In other words, the second end 222 of the first sleeve portion 22 is fitted into the first open end 231 of the second sleeve portion 23, such that at least a part of an outer surface of the first sleeve portion 22 is in contact with an inner surface of the second sleeve portion 23. Additionally, the second open end 235 of the second sleeve portion 23 is formed with an outer thread 234.

In this embodiment, the elements of the heat sink unit 2 are fastened to each other using three fastening members 24. Each of the fastening members 24 is configured as a screw, and penetrates the first and second sleeve portions 22, 23, and extends into the tubular portion 21*b* to fasten together the tubular portion 21*b* and the first and second sleeve portions 22, 23.

To be more precise, an inner surface of the second sleeve portion 23 is formed with three flat face parts 232 in proximity to the first open end 231, and the second end 222 of the hexagonal first sleeve portion 22 has three outer parts that are respectively in contact with the three flat face parts 232. Accordingly, the heat can be transmitted through the first and second sleeve portions 22, 23. Each of the flat face parts 232 has a screw hole 233 for extension of a respective one of the fastening members 24.

In other embodiments, the portions of the heat sink unit 2 (i.e., the end wall portion 21*a*, the tubular portion 21*b*, and the first and second sleeve portions 22, 23) are made from aluminum and formed in one piece in order to obtain the heat sink unit 2 with superior heat conduction effect.

The light-emitting unit 3 is disposed on the heat sink unit 2 and includes: a first circuit board 31 disposed on the first surface 214 of the end wall portion 21*a* and facing toward the closed end 12 of the bulb 1, a second circuit board 32 disposed around the outer surface of the first sleeve portion 22, and a plurality of light-emitting elements 33 respectively mounted on the first and second circuit boards 31, 32.

In this embodiment, the first circuit board 31 is a rigid printed circuit board, and is secured to the first surface 214 of the end wall portion 21*a* using a screw 34.

The second circuit board 32 is a flexible printed circuit board, and is bent to extend along the outer surface of the first sleeve portion 22.

The light-emitting elements 33 are light-emitting diodes. The light-emitting elements 33, which are mounted on the first circuit board 31, face toward the closed end 12 of the bulb 1 to emit light forwardly. The light-emitting elements 33, which are mounted on the second circuit board 32 to surround the first sleeve portion 22, are disposed between the open end 11 and the closed end 12 of the bulb 1 to emit light radially. Accordingly, the lighting apparatus of this invention can provide wide-angle illumination.

Besides, an inner surface 14 of the bulb 1 is coated with a fluorescent coating 15 that can be excited by the light from the light-emitting elements 33 to emit light. The light from the fluorescent coating 15 and the light from the light-emitting elements 33 are different in color, and can be mixed together to produce white light that is close to natural light and that has excellent color rendering properties. For example, when the light emitted from the light-emitting members 33 is blue light and the fluorescent coating 15 can be excited by the bulb light to emit yellow light, the blue light and the yellow light can be mixed together to produce white light.

In addition, the light-emitting unit 3 may further include other electronic components (not shown) to electrically connect to the electrical connector 6 (i.e., a screw base of a bulb), such as an AC/DC converting circuit, electrical wires, etc. Since these electronic components are well-known in the art, detailed descriptions of the same are omitted herein for the sake of brevity.

The heat insulating unit 4 is disposed at least one of a position between the first surface 214 of the end wall portion 21*a* and the first circuit board 31, and a position between the first sleeve portion 22 and the second circuit board 32. In this embodiment, the heat insulating unit 4 includes first, second, and third heat insulators 41, 42 and 43. The first heat insulator 41 is formed as a sheet shape and is disposed between the first surface 214 of the end wall portion 21*a* and the first circuit board 31. The second heat insulator 42 is disposed between the first sleeve portion 22 and the second circuit board 32. The third heat insulator 43 is disposed on the second surface 215 of the end wall portion 21*a*, and cooperates with the first end 221 of the first sleeve portion 22 to define a gap 220 therebetween. The gap 220 is in spatial communication with both of the heat-dissipating space 20 and the inner space 10 of the bulb 1. Therefore, the heat that is generated from the light-emitting unit 3 and that is transferred to the heat-dissipating space 20 can be transferred to the inner space 10 of the bulb 1 via the gap 220. In addition, by virtue of the third heat insulator 43 and the gap 220, the second surface 215 of the end wall portion 21*a* is thermally-insulated from the first sleeve portion 22. Thus, the heat dissipated to the gap 220 is unlikely to be transferred to the end wall portion 21*a*.

Each of the first, second and third heat insulators 41, 42 and 43 is preferably made from a material having a relatively high heat resistance and a relatively low thermal conductivity, such as polyimide (PI). In this embodiment, each of the first, second and third heat insulators 41, 42 and 43 is a PI film having an adhesive surface. Therefore, the first, second and third heat insulators 41, 42 and 43 can be directly and respectively attached to the first surface 214 of the end wall portion 21*a*, the outer surface of the first sleeve portion 22, and the second surface 215 of the end wall portion 21*a*. By such arrangement of the heat insulating unit 4, the first and second circuit boards 31, 32 do not contact directly the heat sink unit 2. Of course, the heat insulating unit 4 can also be made from other suitable materials.

The annular seat 5 is configured as a tube having a trumpet-shaped opening and covering the open end 11 of the bulb 1, such that the annular seat 5 is coupled to the bulb 1 in proximity to the open end 11 of the bulb 1.

The electrical connector 6 is configured as a tube having an open end coupled to the annular seat 5, and is adapted for connection to an external power source. The electrical connector 6 has an inner wall 61 formed with an inner thread 611, and an outer wall 62 formed with an outer thread 621 for coupling threadedly with an electrical socket (not shown). The second sleeve portion 23 penetrates the annular seat 5, and the outer thread 234 of the second sleeve portion 23 is engaged with the inner thread 611 of the electrical connector 6. Accordingly, the annular seat 5 is secured between the second sleeve portion 23 and the electrical connector 6. Besides, since the heat sink unit 2 is in contact with the electrical connector 6, heat can be transferred between the heat sink unit 2 and the electrical connector 6.

It should be noted that the heat sink unit 2 and the electrical connector 6 can be connected using any other possible manner as long as they are in tight contact with each other.

With the lighting apparatus of this invention, the heat generated by the light-emitting unit 3 can be dissipated in the manner described hereinbelow.

The heat generated from the light-emitting elements 33 mounted on the first circuit board 31 is transferred to the end wall portion 21*a* through the first circuit board 31 and the first heat insulator 41, and is further transferred to the tubular portion 21*b*. Since the tubular portion 21*b* is in thermal contact with the second sleeve portion 23, the heat may be further transferred to the second sleeve portion 23.

Similarly, the heat generated from the light-emitting elements 33 mounted on the second circuit board 32 is transferred to the first sleeve portion 22 through the second circuit board 32 and the second heat insulator 42. Since the first sleeve portion 22 is in thermal contact with the second sleeve portion 23, the heat may be further transferred to the second sleeve portion 23.

The heat transferred to the second sleeve portion 23 may be further transferred to the electrical connector 6, and then dissipated externally via the electrical connector 6.

Moreover, the heat may also be transferred to the air in the heat-dissipating space 20, and then dissipated to the air in the inner space 10 of the bulb 1 through the gap 220.

It should be noted that, although the heat insulating unit 4 has relatively low thermal conductivity as stated above, the heat may also be transferred through the heat insulating unit 4 when two opposite sides of each of the first, second and third heat insulators 41, 42 and 43 of the heat insulating unit 4 have a large temperature difference. Therefore, the heat generated from the light-emitting elements 33 and then transferred to the first and second circuit boards 31, 32 may be transferred to the end wall portion 21*a* and the first sleeve portion 22 through the first and second heat insulators 41, 42 respectively after the lighting apparatus of this invention is turned on for a short period of time. This is because after a short period of time, the temperatures of the light-emitting elements 33 and the first and second circuit boards 31, 32 are raised to be much higher than those of the end wall portion 21*a* and the first sleeve portion 22.

On the other hand, after the lighting apparatus of this invention is turned on for a long period of time, the temperature difference between two sides of each of the first, second and third heat insulators 41, 42 and 43 of the heat insulating unit 4 is greatly reduced, since the heat generated from the light-emitting elements 33 is continuously transferred to the end wall portion 21*a* and the first sleeve portion 22 through the first and second circuit boards 31, 32, and the first and second heat insulators 41, 42. At this time, by virtue of the first and second heat insulators 41, 42, the heat energy accumulated in the end wall portion 21*a* and the first sleeve portion 22 is likely to be transferred to the second sleeve portion 23 and the heat-dissipating space 20, and is unlikely to be transmitted to the first and the second circuit boards 31, 32. Therefore, even if the lighting apparatus is small-sized, and the surface area of the heat sink unit 2 is insufficient for efficient heat-dissipation, retardation of the heat-dissipation can be prevented.

Moreover, since the end wall portion 21*a* is thermally-insulated from the first sleeve portion 22 by virtue of the gap 220 and the third heat insulator 43, the heat generated by the light-emitting elements 33 mounted on the second circuit board 32 and then transferred to the air in the gap 220 is not likely to be transferred to the light-emitting elements 33 mounted on the first circuit board 31 through the end wall portion 21*a*.

By virtue of the heat insulating unit 4 and the heat sink unit 2 in the lighting apparatus of this invention, the heat-dissipation of the heat sink unit 2 can be enhanced, thereby prolonging the service life of the light-emitting unit 3.

In the following Table 1, the lighting apparatus of this invention that has the heat insulating unit 4 serves as Example, and the conventional lighting apparatus without the heat insulating unit serves as Comparative Example. The "initial value" means the temperature measured directly after the lighting apparatus was turned on. The temperatures respectively measured after the lighting apparatus was turned on for 10, 20, 30 and 40 minutes are shown in Table 1.

Besides, the term "LEDs on A side" means the junction temperature between the first circuit board 31 and the light-emitting elements 33 mounted thereon, while the term "LEDs on B side" means the junction temperature between the second circuit board 32 and the light-emitting elements 33 mounted thereon.

TABLE 1

| Temperature measured after the lighting apparatus was turned on | | Initial value (° C.) | 10 min. (° C.) | 20 min. (° C.) | 30 min. (° C.) | 40 min. (° C.) |
|---|---|---|---|---|---|---|
| Example | LEDs on A side | 22.4 | 72.3 | 87.5 | 89.7 | 90.3 |
| | LEDs on B side | 26.4 | 77 | 89 | 92 | 92 |
| | Air in the bulb | 22.5 | 50 | 57 | 58 | 58 |
| Comparative Example | LEDs on A side | 22.4 | 91.9 | 107.5 | 110.2 | 111.3 |
| | LEDs on B side | 26.4 | 84 | 97 | 102 | 103 |
| | Air in the bulb | 22.5 | 56.7 | 65.4 | 65.9 | 66.9 |

As shown in Table 1, in the Comparative Example, the temperature of the light-emitting elements was approximately increased by 60° C. to 70° C. within 10 minutes after the lighting apparatus was turned on. In the Example, the temperature of the light-emitting elements was approximately increased by 50° C. Besides, after the lighting apparatus was turned on for 40 minutes, all of the temperatures measured in the Example of this invention are much lower than those measured in the Comparative Example.

With the heat insulating unit 4 disposed between the heat sink unit 2 and the light-emitting unit 3 to facilitate heat-dissipating effect of the heat sink unit 2, the lighting apparatus of this invention may have enhanced heat-dissipating ability, even if the lighting apparatus is small-sized and has insufficient heat-exchanging area. Thus, the light-emitting unit 3 may be prevented from overheating, thereby prolonging the service life of the lighting apparatus of this invention.

Figure 5:
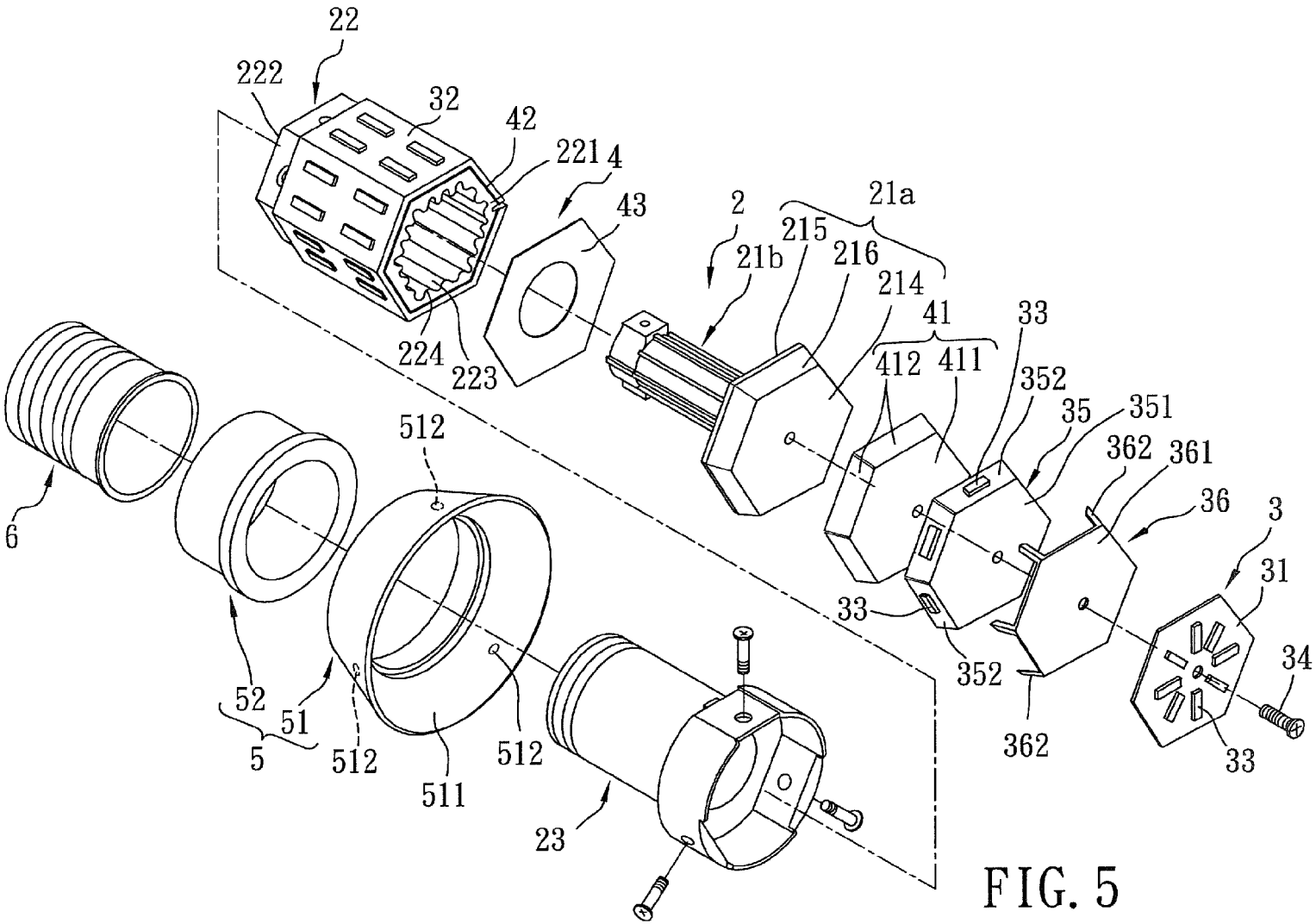
FIG. 5 is an exploded perspective view of the second preferred embodiment of a lighting apparatus according to the present invention.
Figure 6:
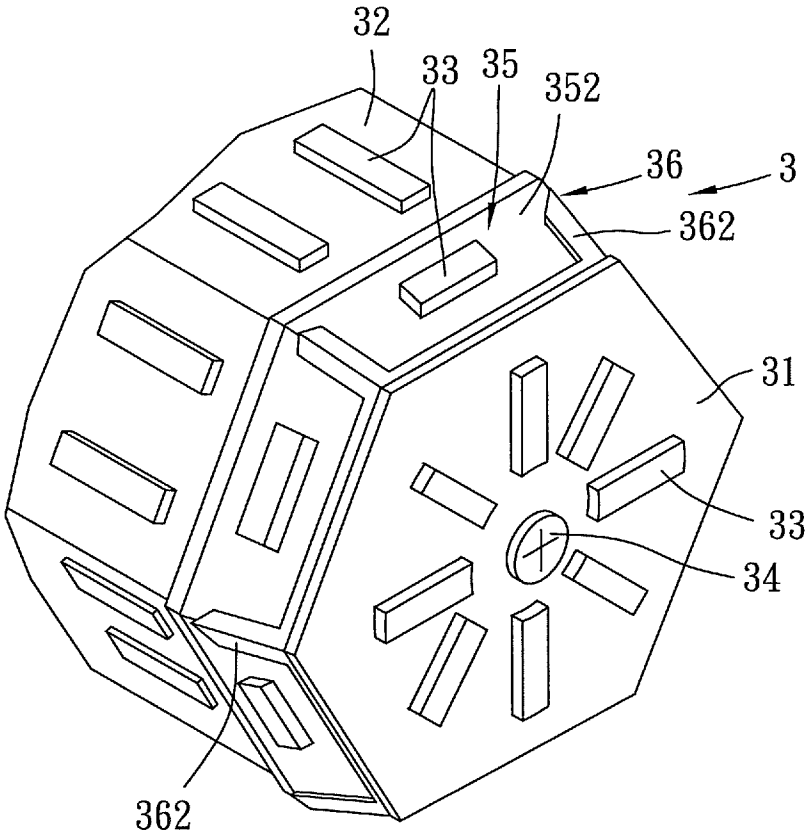
FIG. 6 is a fragmentary enlarged view of the second preferred embodiment of a light-emitting unit of the lighting apparatus according to the present invention.
Figure 7:
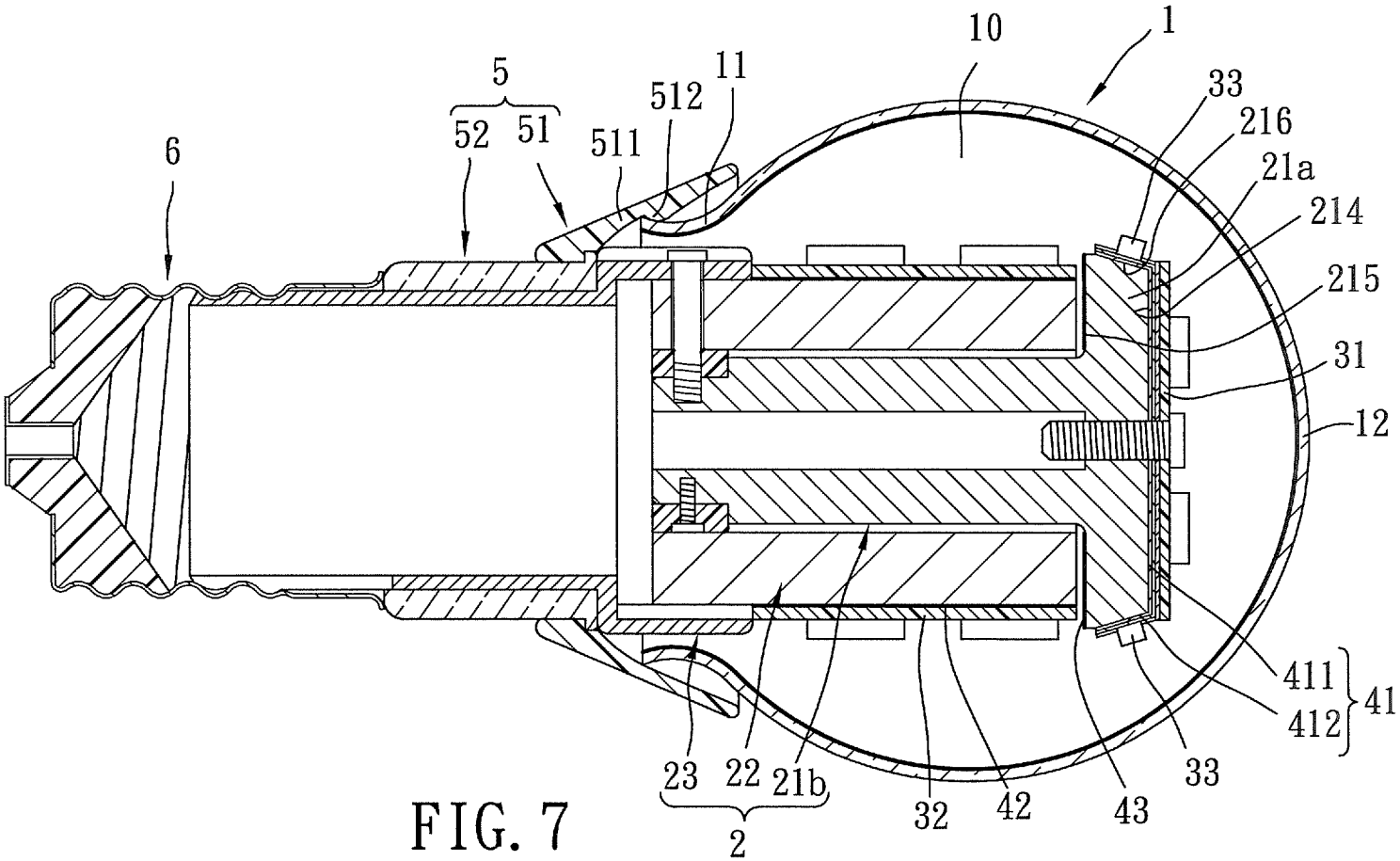
FIG. 7 is a sectional view of the second preferred embodiment of the lighting apparatus according to the present invention.

Referring to FIGS. 5-7, the second preferred embodiment of a lighting apparatus according to the present invention comprises a bulb 1, a heat sink unit 2, a light-emitting unit 3, a heat insulating unit 4, an annular seat 5, and an electrical connector 6. The second preferred embodiment differs from the first preferred embodiment in the structures of the end wall portion 21*a*, the light-emitting unit 3, the first heat insulator 41 and the annular seat 5.

In this embodiment, the end wall portion 21*a* further includes a lateral surface 216 interconnecting the first and second surfaces 214, 215. The lateral surface 216 is an inclined annular surface and is flared from a periphery of the first surface 214 toward a periphery of the second surface 215.

The light-emitting unit 3 further includes a third circuit board 35 disposed between the first heat insulator 41 and the first circuit board 31, and a locking plate 36 disposed between the third circuit board 35 and the first circuit board 31. The third circuit board 35 is a flexible printed circuit board and includes a flat part 351 disposed corresponding to the first surface 214 of the end wall portion 21*a*, and a plurality of extension parts 352 extending from an edge of the flat part 351 to cover an edge part 412 of the first heat insulator 41 such that the edge part 412 of the first heat insulator 41 is disposed between the lateral surface 216 of the end wall portion 21*a* and the extension parts 352 of the third circuit board 35. In this embodiment, the light-emitting elements 33 are respectively mounted on the first and second circuit boards 31, 32 and the extension parts 352 of the third circuit board 35.

The locking plate 36 is made of aluminum, and has a plate part 361 covering the flat part 351 of the third circuit board 35, and a plurality of claws 362 extending from an edge of the plate part 361 to press the extension parts 352 of the third circuit board 35 toward the lateral surface 216 of the end wall portion 21*a*. Preferably, each of the claws 362 presses a connection boundary area between two adjacent extension parts 352. Alternatively, the plate part 361 and the claws 362 can be originally in the same plane surface, and when assembling the lighting apparatus, the claws 362 are bent to press the extension parts 352.

In this embodiment, the extension parts 352 are bent portions of the flexible third circuit board 35. Thus, the extension parts 352 tend to move apart from the lateral surface 216 of the end wall portion 21*a*. By virtue of the claws 362, the extension parts 352 are pressed toward the lateral surface 216. Although the plurality of claws 362 and the plurality of extension parts 352 are included in this embodiment, a single claw and a single extension part may be included in other embodiments.

The first heat insulator 41 includes a plane part 411 and the edge part 412. The plane part 411 is disposed between the first surface 214 of the end wall portion 21*a* and the flat part 351 of the third circuit board 35. The edge part 412 extends annularly from a periphery of the plane part 411 and is disposed between the lateral surface 216 of the end wall portion 21*a* and the extension parts 352 of the third circuit board 35. Thus, in this embodiment, the third circuit board 35 is thermally insulated from the end wall portion 21*a* by virtue of the first insulator 41.

The annular seat 5 consists of two portions in this embodiment, that is, a trumpet-shaped portion 51 and a tube portion 52. The trumpet-shaped portion 51 is made of a plastic material and surrounds the open end 11 of the bulb 1. The tube portion 52 is made of a ceramic material and is disposed between the trumpet-shaped portion 51 and the electrical connector 6.

The trumpet-shaped portion 51 includes a surrounding wall 511 that is flared from one end adjacent to the tube portion 52 toward another end adjacent to the bulb 1 to surround the open end 11 of the bulb 1, and a plurality of protrusions 512 each protruding from an inner face of the surrounding wall 511 to engage with an outer surface of the bulb 1 in proximity to the open end 11. The trumpet-shaped portion 51 is preferably made of an elastic plastic material. Thus, the open end 11 of the bulb 1 can be pressed over the protrusions 512 and inserted into an inner space of the trumped-shaped portion 51, thereby engaging the outer surface of the bulb 1 via the protrusions 512, and thereby securing the bulb 1 to the annular seat 5. Besides, the bulb 1 may be secured to the annular seat 5 using an adhesive agent. The trumped-shaped portion 51 may be heated to facilitate the bulb 1 to be pressed over the protrusions 512.

The tube portion 52, which is connected to a narrowed side of the trumped-shaped portion 51, surrounds a part of the second sleeve portion 23 to be in close contact with the second sleeve portion 23. The tube portion 52 has a certain level of air permeability since it is made of a ceramic material such as calcined clay.

After the lighting apparatus of this invention is turned off, the air temperature inside the bulb 1 will decrease to the room temperature, thereby increasing the humidity inside the bulb 1. With the tube portion 52 made of a ceramic material, the moisture inside the bulb 1 can be released away from the bulb 1 through joint seams between the bulb 1 and the annular seat 5 by virtue of the tube portion 52. Moreover, the tube portion 52 has enhanced heat dissipation efficiency since the same is made of a ceramic material that has a higher thermal conductivity than a plastic material.

In this embodiment, as best shown in FIG. 6, the light-emitting elements 33 on the third circuit board 35 emit the light at a different angle from those on the first and second circuit boards 31, 32. Accordingly, the lighting apparatus of the second embodiment of this invention can provide a wider illumination than that of the first embodiment of this invention.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A lighting apparatus comprising:

a bulb having an open end and a closed end opposite to said open end;

a heat sink unit disposed in an inner space of said bulb, and including an end wall portion and a first sleeve portion, said end wall portion having two opposite first and second surfaces, and being disposed in proximity to said closed end, such that said first surface faces toward said closed end of said bulb and such that said second surface faces toward said open end of said bulb, said first sleeve portion having opposite first and second ends, said first end of said first sleeve portion being disposed adjacent to said end wall portion, said second end of said first sleeve portion being disposed adjacent to said open end of said bulb;

a light-emitting unit disposed on said heat sink unit and including: a first circuit board disposed on said first surface of said end wall portion, a second circuit board disposed around said first sleeve portion, and a plurality of light-emitting elements respectively mounted on said first and second circuit boards;

a heat insulating unit disposed at least one of a position between said first surface of said end wall portion and said first circuit board, and a position between said first sleeve portion and said second circuit board;

an annular seat coupled to said bulb in proximity to said open end; and an electrical connector coupled to said annular seat and adapted for connection to an external power source.

2. The lighting apparatus of claim 1, wherein said heat insulating unit includes:

a first heat insulator disposed between said first surface of said end wall portion and said first circuit board; and a second heat insulator disposed between said first sleeve portion and said second circuit board.

3. The lighting apparatus of claim 2, wherein said heat insulating unit further includes a third heat insulator that is disposed on said second surface of said end wall portion, and that cooperates with said first end of said first sleeve portion to define a gap therebetween.

4. The lighting apparatus of claim 3, wherein said heat sink unit further has a tubular portion that is connected to and extends from said second surface of said end wall portion and that is surrounded by said first sleeve portion, said first sleeve portion and said tubular portion defining a heat-dissipating space therebetween, said heat-dissipating space being in spatial communication with said gap.

5. The lighting apparatus of claim 4, wherein said tubular portion has an outer surface that is formed with a plurality of protrusions, and that faces toward said heat-dissipating space; and wherein said first sleeve portion has an inner surface facing toward said outer surface of said tubular portion and formed with a plurality of troughs and ridges.

6. The lighting apparatus of claim 4, wherein said second circuit board is a flexible printed circuit board.

7. The lighting apparatus of claim 4, wherein said heat sink unit further has a second sleeve portion and a fastening member;

wherein said second sleeve portion includes a first open end surrounding said second end of said first sleeve portion such that at least a part of an outer surface of said first sleeve portion is in contact with an inner surface of said second sleeve portion, and a second open end formed with an outer thread; and wherein said fastening member penetrates said first and second sleeve portions, and extends into said tubular portion to fasten together said tubular portion and said first and second sleeve portions.

8. The lighting apparatus of claim 7, wherein said electrical connector includes an inner wall formed with an inner thread to engage said outer thread of said second sleeve portion.

9. The lighting apparatus of claim 1, wherein said heat insulating unit is made from polyimide.

10. The lighting apparatus of claim 1, wherein said light-emitting elements are light-emitting diodes.

11. The lighting apparatus of claim 2, wherein:

said end wall portion further includes a lateral surface interconnecting said first and second surfaces;

said light-emitting unit further includes a third circuit board disposed between said first heat insulator and said first circuit board, and a locking plate disposed between said third circuit board and said first circuit board;

said third circuit board includes: a flat part disposed corresponding to said first surface of said end wall portion; and at least one extension part extending from an edge of said flat part to cover an edge part of said first heat insulator such that said edge part of said first heat insulator is disposed between said lateral surface of said end wall portion and said extension part of said third circuit board, said light-emitting elements being respectively mounted on said first and second circuit boards and said extension part of said third circuit board; and said locking plate has a plate part covering said flat part of said third circuit board, and at least one claw extending from an edge of said plate part to press said extension part of said third circuit board toward said lateral surface of said end wall portion.

12. The lighting apparatus of claim 11, wherein said lateral surface of said end wall portion is an inclined annular surface and is flared from a periphery of said first surface toward a periphery of said second surface.

13. The lighting apparatus of claim 11, wherein said first heat insulator further includes a plane part disposed between said first surface of said end wall portion and said flat part of said third circuit board;

said edge part extending annularly from a periphery of said plane part and being disposed between said lateral surface of said end wall portion and said extension part of said third circuit board.

14. The lighting apparatus of claim 11, wherein said annular seat includes:

a trumpet-shaped portion made of a plastic material, surrounding said open end of said bulb, and engaging said bulb; and a tube portion made of a ceramic material and disposed between said trumpet-shaped portion and said electrical connector.

15. The lighting apparatus of claim 14, wherein said trumpet-shaped portion includes:

a surrounding wall that surrounds said open end of said bulb; and a plurality of protrusions each protruding from an inner face of said surrounding wall to engage with an outer surface of said bulb in proximity to said open end.

* * * * *